US005363316A

United States Patent [19]

Spencer

[11] Patent Number: 5,363,316

[45] Date of Patent: Nov. 8, 1994

[54] MAINTENANCE MONITORING SYSTEM FOR DETACHABLE SKI LIFT CARRIER VEHICLES

[76] Inventor: Paul W. Spencer, 649 Pinon Dr., Basalt, Colo. 81621

[21] Appl. No.: 206,199

[22] Filed: Mar. 3, 1994

Related U.S. Application Data

[63] Continuation of Ser. No. 898,814, Jun. 15, 1992, abandoned.

[51] Int. Cl.[5] ..... G07C 3/02

[52] U.S. Cl. ..... 364/550; 377/15; 377/16; 364/551.01

[58] Field of Search ..... 364/550, 551.01, 569; 377/15, 16

[56] References Cited

U.S. PATENT DOCUMENTS

| | | | |
|---|---|---|---|
| 3,844,223 | 10/1974 | Brian | 104/173 |
| 4,003,314 | 11/1977 | Pearson | 104/1 R |
| 4,067,061 | 1/1978 | Juhasz | 377/21 X |
| 4,226,187 | 10/1980 | Paulsen et al. | 104/182 |
| 4,404,641 | 9/1983 | Bazarnik | 377/20 X |
| 4,563,955 | 1/1986 | Tarassoff | 104/168 |
| 4,612,623 | 9/1986 | Bazarnik | 377/20 X |
| 4,617,829 | 10/1986 | Tarassoff | 73/865.8 |
| 4,641,584 | 2/1987 | Bertrand | 104/173.2 |
| 4,785,738 | 11/1988 | Mollet | 104/173.2 |
| 5,225,996 | 7/1993 | Weber | 364/550 |
| 5,231,594 | 7/1993 | Knibiehler et al. | 364/551.01 |

*Primary Examiner*—Edward R. Cosimano
*Attorney, Agent, or Firm*—William E. Hein

[57] ABSTRACT

A maintenance monitoring system for detachable carrier vehicles of a moving transportation system includes a bar code label, or other readable medium containing vehicle identification information, on each of the carrier vehicles of the transportation system, a stationary input unit positioned for reading the vehicle identification information from each of the carrier vehicles as the carrier vehicles pass a specified point along the route of the transportation system, a decoder for converting the vehicle identification information read by the input unit to a computer data format, and a computer system for receiving the vehicle identification information, for processing the vehicle identification information to accumulate the usage of each carrier vehicle of the transportation system, for comparing the accumulated usage of each carrier vehicle to usage levels at which that carrier vehicle is to receive scheduled maintenance, and for displaying to the user selected parameters regarding the accumulated usage of a selected one or more carrier vehicles and the relationship of that accumulated usage to the usage levels at which the selected one or more carrier vehicles is to receive scheduled maintenance.

19 Claims, 3 Drawing Sheets

MAINTENANCE MONITORING SYSTEM FOR DETACHABLE SKI LIFT CARRIER VEHICLES

CROSS REFERENCE TO RELATED APPLICATION

This application is a continuation of application Ser. No. 07/898,814, filed Jun. 15, 1992, now abandoned.

BACKGROUND AND SUMMARY OF THE INVENTION

This invention relates generally to ski lifts and more specifically to a monitoring system applicable to any lift having detachable carrier vehicles such as chairs, gondolas or aerial tramway cars. Over the past several years, the ski and transportation industries have implemented faster and larger transportation carrier vehicles in order to move more passengers in a shorter time. Exemplary of such carrier vehicles are gondolas, trams, and high speed chairs, including quints, quads, triples, and doubles. With these high speed carrier vehicles has come the need for loading and unloading passengers in the shortest possible time. In order to satisfy this need, these carrier vehicles have become more complex mechanically. For example, almost all such high speed carrier vehicles are detachable, meaning that the carrier vehicle simply detaches from the main cable driving the lift when passengers are to be loaded or unloaded, thereby allowing the carrier vehicle to move at a much slower speed. The slower speed allows passengers to load or unload in a comfortable and safe amount of time. After the carrier vehicle has moved past a loading or unloading point, the vehicle is automatically reattached to the main cable for high speed travel to the next loading or unloading station.

With the increased mechanical complexity of these high speed carrier vehicles has come the need for increased maintenance in order to promote reliability and passenger safety. In order to properly maintain these carrier vehicles, a consistent record of their usage is necessary. Due to the fact that they can be removed from a particular lift or cable system at any time, it is essential that the usage of each carrier vehicle be accounted for separately. When one carrier vehicle requires service, it is simply removed from the cable system and replaced with another carrier vehicle. It is also common practice to vary the number of carrier vehicles in operation on a lift or cable system from day to day, depending on the anticipated passenger load. This constant shuffling of carrier vehicles between storage areas and the cable system has made it difficult, if not impossible, to accurately account for the actual usage of a given carrier vehicle.

One known method for recording the usage of carrier vehicles is a manual one that requires noting each carrier vehicle on a given cable system at the beginning of a day. At the end of the day, the total number of round trip cycles completed by the cable system is estimated and recorded for each of the vehicles on the system. Maintenance is typically scheduled for carrier vehicles based upon the number of cycles a vehicle has completed. In making a trip from the bottom of a lift to the top and then back to the bottom, the detachable grips of each vehicle must be opened and closed four times. In the case of a typical ski area, this manual recording method would require logging approximately three thousand carrier vehicles each morning. Thus, the time required to manually record the vehicle identification information is prohibitive, since the vehicles must be moved around the cable system to permit this information to be recorded. At the same time, the estimations of vehicle cycles during each day would need to be compiled for years at a time, resulting in even more paperwork and opportunity for error.

Due to the sheer volume of recorded information required under the system described above, an initial time-based system was devised for recording the required maintenance cycles of high speed chair lifts, and ski areas have never been required to keep detailed records as to the exact usage of each such carrier vehicle. However, recording of daily usage information for gondola vehicles was originally required on a daily basis since these vehicles are shuffled on and off a given cable system more frequently than are chair vehicles. This time-based system dictates that movable parts, particularly grips, be serviced on a time interval of several years. Typically, each chair is serviced in sequence and then returned to the lift. For the first several years that high speed chair lifts were in operation, this service schedule seemed to work well, and only minor safety problems arose. However, in the past few years, some chair grips have been found to be under-maintained, while others have been over-maintained. Possible explanations for this inconsistency are that some grips have received more usage than others and that manual records of service sequences have become scrambled over time. As a result, some vehicles are being overlooked, and a basically random maintenance sequence is being followed. In the more recent past, several accidents around the world have occurred due to lack of maintenance on high speed chair vehicles, thus suggesting that the time-based maintenance system requires modification to more accurately account for the usage of each vehicle.

In the case of gondolas, a manual recording system has been in daily use. In the United States, it has not been particularly difficult to record the vehicles in use on a gondola system each day because each ski area typically has no more than one such system. However, in Europe and, more recently, Japan, some ski areas have as many as twenty-four gondola systems. In these areas, the sheer volume of information to be recorded has led to adoption of the time-based system described above. Since gondola systems are arranged so that each vehicle operates at heights of 100–1000 feet above the ground, failure of a particular vehicle can be fatal. The typical gondola system includes approximately 220 carrier vehicles. At any given time, only 60 to 180 of these are in operation. The remainder are in storage or being serviced. Since the number of vehicles in actual operation varies significantly from day to day as a function of passenger traffic, it has become nearly impossible to keep track of which vehicles are on and off the cable system each day. For this reason, U.S. ski areas with gondolas are now on a time-based maintenance schedule that results in a guessing game as to which vehicles need service and which do not. Even if an accurate daily record is kept of all vehicles in operation, a slight error in estimating the number of cycles performed that day results in a large percentage error for the day, since each vehicle performs only 14–18 cycles per day. When tabulated over a time-based maintenance interval of several years, this error becomes even more significant, again regularly resulting in cases of over-maintenance and under-maintenance. Since the average service performed on each gondola vehicle is very costly, unnecessary maintenance has an adverse economic impact on the ski area, while under-maintenance jeopardizes passenger safety.

It is therefore the principal object of the present invention to provide a maintenance monitoring system for detachable carrier vehicles of a moving transportation system in which the daily operational usage of each carrier vehicle is automatically recorded and accumulated.

It is a further object of the present invention to provide a maintenance monitoring system for detachable carrier vehicles of a moving transportation system in which the accumulated usage of each carrier vehicle is compared to usage levels at which that carrier vehicle is to receive scheduled maintenance and for displaying to the user selected parameters regarding the accumulated usage of a selected one or more carrier vehicles and the relationship of that accumulated usage to the usage level at which the selected one or more carrier vehicles is to receive scheduled maintenance.

These and other objects are accomplished in accordance with the illustrated preferred embodiment of the present invention by providing a bar code, or other readable medium containing vehicle identification information, on each of the carrier vehicles of the transportation system, a stationary input unit positioned for reading the vehicle identification information from each of the carrier vehicles as the carrier vehicles pass a specified point along the route of the transportation system, a decoder for converting the vehicle identification information read by the input unit to a computer data format, and a computer system for receiving the vehicle identification information, for processing that vehicle identification information to accumulate the usage of each carrier vehicle of the transportation system, for comparing the accumulated usage of each carrier vehicle to usage levels at which that carrier vehicle is to receive scheduled maintenance, and for displaying to the user selected parameters regarding the accumulated usage of a selected one or more carrier vehicles and the relationship of that accumulated usage to the usage level at which the selected one or more carrier vehicles is to receive scheduled maintenance.

DESCRIPTION OF THE PREFERRED EMBODIMENT

Figure 1:
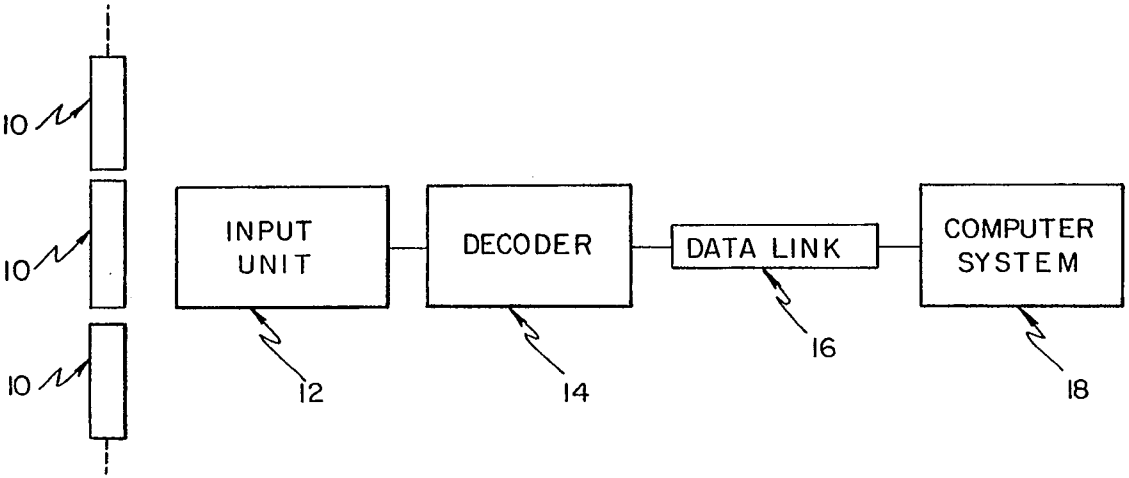
FIG. 1 is an overall block diagram of hardware employed in the maintenance monitoring system for detachable ski lift carrier vehicles of the present invention.

Referring now to FIG. 1, there are shown a series of detachable moving carrier vehicles 10. Carrier vehicles 10 may comprise, for example, the chairs of a high speed chair lift or the passenger vehicles of a gondola lift or aerial tramway. Each of the carrier vehicles 10 preferably includes a photocomposed bar code label containing information identifying each particular vehicle. Alternatively, each of the carrier vehicles 10 may include a transmitter and associated antenna capable of transmitting information that identifies a particular vehicle. A stationary input unit 12 is positioned along the route of the chair lift, gondola or aerial tramway, preferably near the top or bottom thereof, to read the photocomposed bar code label or to receive the transmitted indentification information of each one of carrier vehicles 10 as it passes in proximity to input unit 12. Input unit 12 may comprise any of a number of commercially available products, such as a Symbol Technology Model SL6320 or SL5000 laser reader, charged coupled device (CCD), or radio or microwave receiver, for example. A decoder 14, coupled to input unit 12, serves to convert the raw carrier vehicle identification information into formatted carrier vehicle identification information in accordance with a desired computer data format, such as ASCII. Alternatively, decoder 14 and input unit 12 may be integrated as a single component. The formatted carrier vehicle identification information is then conveyed via a data link 16 to a computer system 18. Data link 16 may simply comprise a hard-wired cable between decoder 14 and computer system 18 or it may comprise any of a number of commercially available radio, optical, satellite or microwave data communication links. The use of a communication link other than a hard-wired link allows computer system 18 to receive formatted carrier vehicle identification information from a number of individual lifts or transportation systems. Computer system 18 may comprise any of a number of commercially available IBM compatible personal computer systems, such as a 386 40 Mhz PC having 4MB of RAM, a 120MB hard drive, a suitable modem, a VGA color monitor, an AT I/O, a mouse, and a high speed printer. Computer system 18 is preferably configured with commercially available software comprising DOS, Windows, Fastback Plus, and Norton PC Anywhere for Windows. DOS is, of course, the general operating system, while Fastback serves as a utility to back up the system information. Norton PC Anywhere provides a modem interface. In addition, computer system 18 is configured with the maintenance monitoring software documented in the flow charts of FIGS. 2A–C, which may be written using Borland Turbo Pascal for Windows. The maintenance monitoring software operates on the formatted carrier vehicle identification information to update the usage of each of the carrier vehicles sensed by input unit 12, as well as the daily and cumulative usage of the entire transportation system. The process of reading carrier vehicle identification information continues for the entire time that the transportation system is in use. When the transportation system closes at the end of a day, for example, the maintenance monitoring software compiles the daily operations and updates the usage of every carrier vehicle in operation at any time during that day. The cumulative usage of each carrier vehicle is automatically compared to usage levels at which a carrier vehicle is to receive scheduled maintenance.

Figure 3:
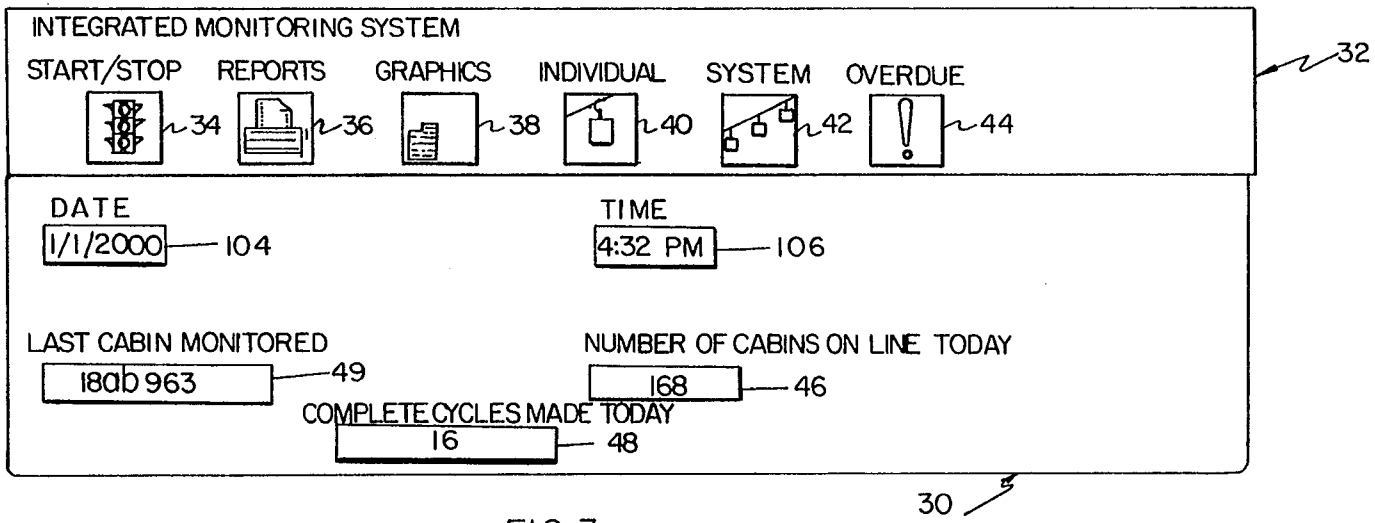
FIG. 3 is a diagram illustrating information displayed by the computer of FIG. 1, including a user-selectable function menu.
Figure 2A:
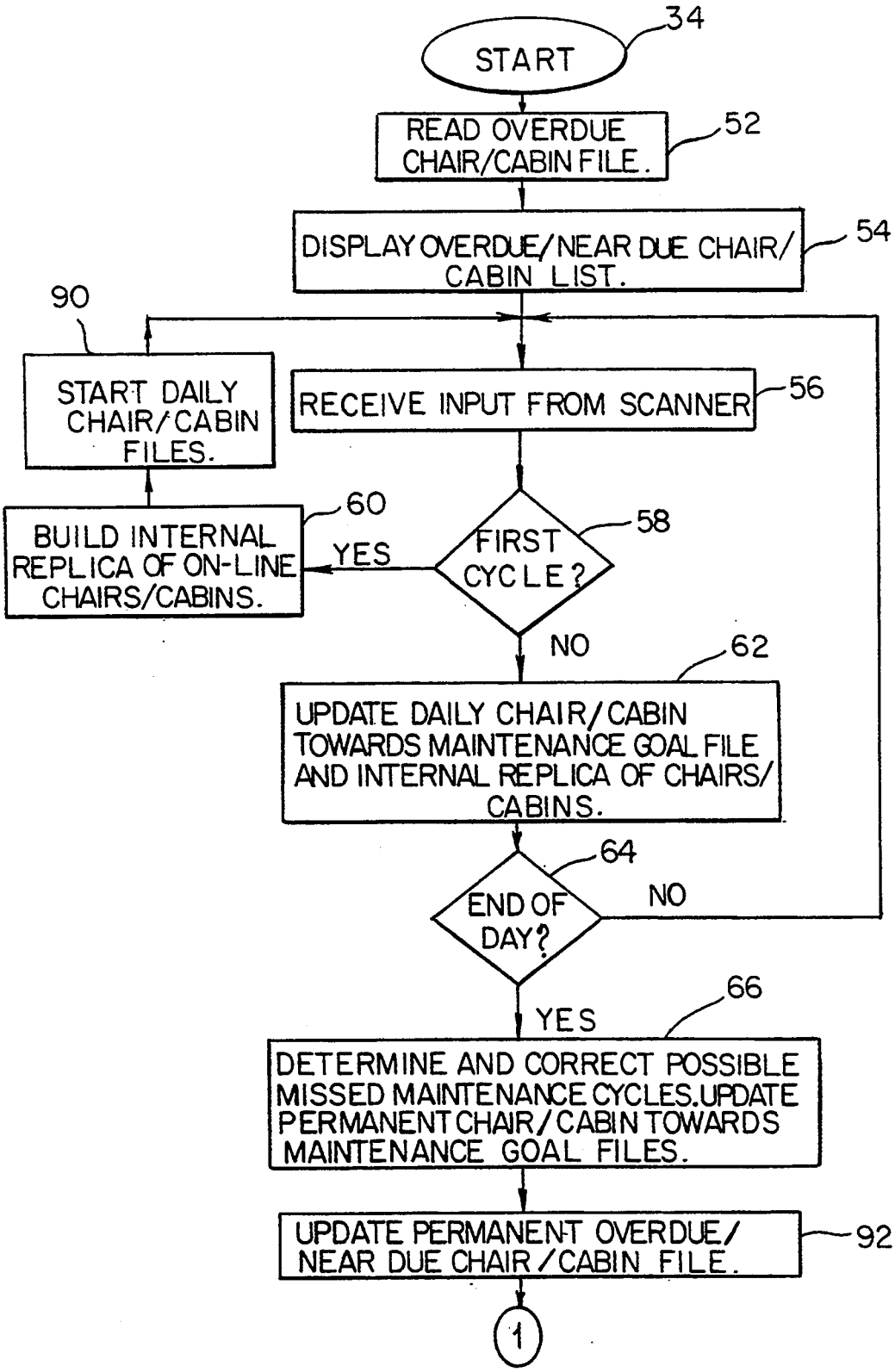
FIG. 2A–C are a flow chart of the maintenance monitoring routines and subroutines performed by the computer of FIG. 1.
Figure 2B:
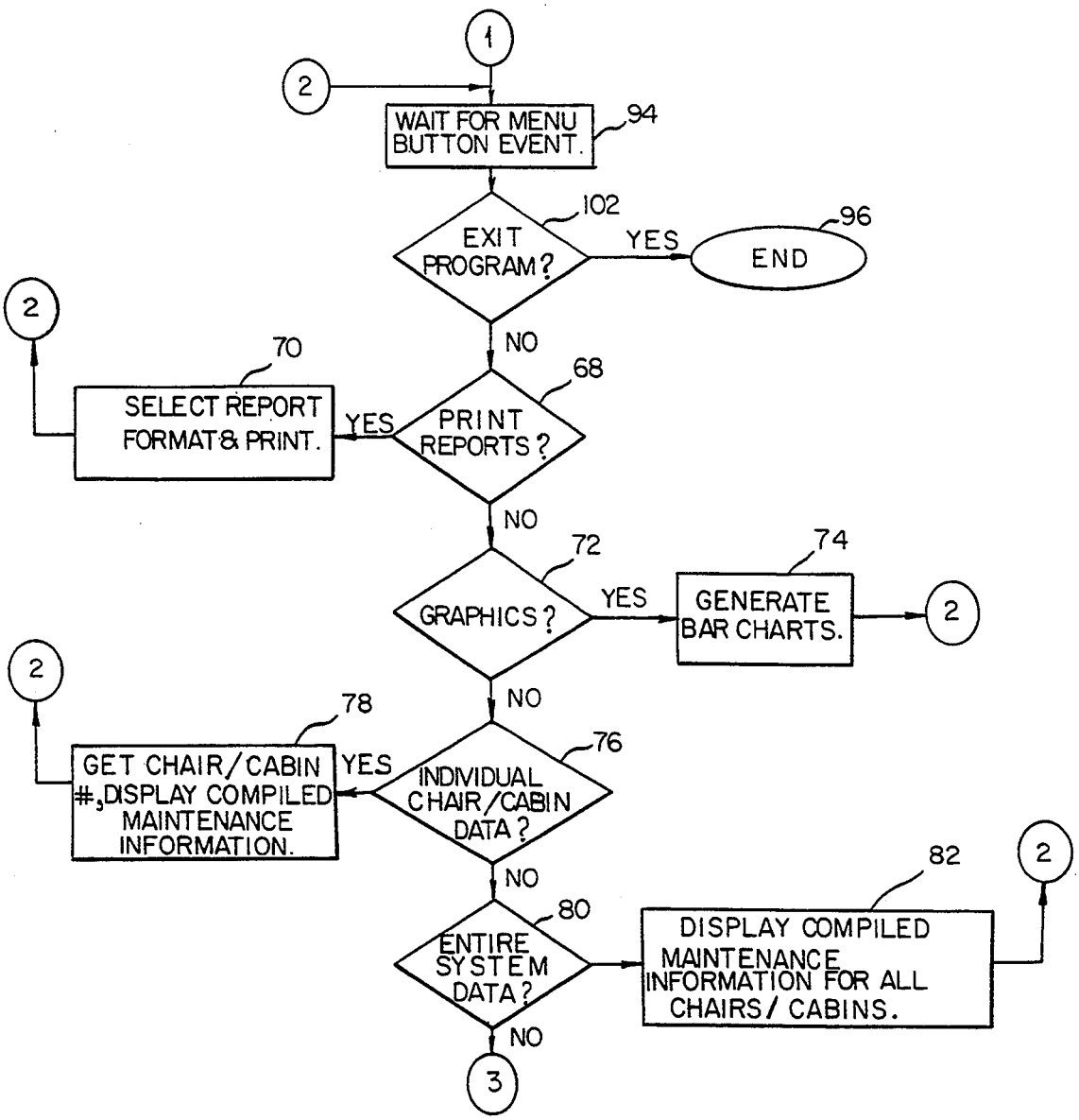
Figure 2C:
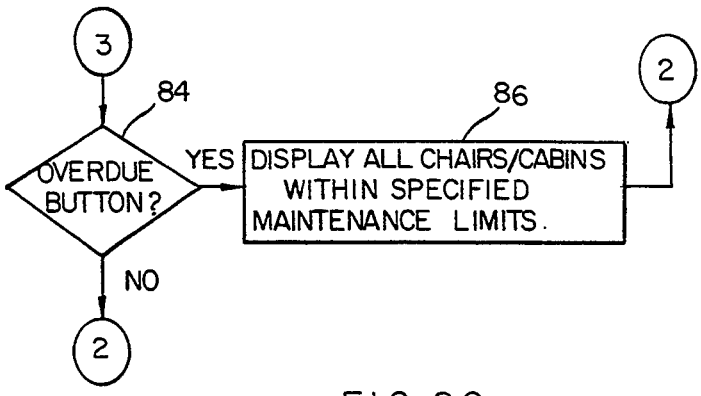

Operation of the maintenance monitoring system of the present invention may be further understood with reference to the flow charts of FIGS. 2A–C and the computer display diagram of FIG. 3. Current date and time are visually display positions 104 and 106, respectively, of computer display 30. A START/STOP user function 34 selectable from a menu section 32 of computer display 30 permits the user to select either a START function at the beginning of a working day or a STOP function at the end of the working day. The START function 34 disables selection of any other function except STOP and conditions the maintenance monitoring software to receive carrier vehicle identification information, in accordance with step 52 of the flow chart of FIG. 2A, by displaying a list of carrier vehicles that require or are close to requiring scheduled maintenance, in accordance with step 54 of that flow chart. This list also provides information as to the location of a particular carrier vehicle. The START function 34 also enables input unit 12 to cause it to read vehicle identification information, in accordance with step 56 of the flow chart of FIG. 2A, when operation of the transportation system is initiated. The vehicle identification information is displayed at display position 49 of computer display 30. Upon the first daily reading of the vehicle identification information for a particular carrier vehicle, as determined at step 58 of the flow chart of FIG. 2A, the maintenance monitoring software creates a temporary daily file in which the usage of that vehicle for the current day is contained. At the same time, the maintenance monitoring software begins to build an imaginary linked list of all of the carrier vehicles in operation during the current day, in accordance with step 60 of the flow chart of FIG. 2A. At the end of one complete trip of a carrier vehicle on the transportation system, the number of carrier vehicles in operation during the current day is displayed to the user at display position 46 of computer display 30. The displayed number of carrier vehicles in operation may change during the course of the day if, for example, a particular carrier vehicle was not initially recognized. Since this imaginary linked list of carrier vehicles currently in operation is constantly updated, in accordance with step 62 of the flow chart of FIG. 2A, it is only necessary that input unit 12 identify a few of the carrier vehicles 100% of the time. If the result of the inquiry is "no", processing continues with step 62 to update each carrier vehicle toward it maintenance goals and updates the internal on-line replica if necessary. This new information provides a change for the current on-line list.If the result of the inquiry at step 58 is "yes", indicating that a particular carrier wvehicle is completing its first operational cycle of the day, processing continues at step 60 to continue building an internal replica of the on-line carrier vehicles by adding the vehicle identification information of the current carrier scanned to the bottom of the internal replica. Processing then proceeds to step 90 to start or open the scanned carrier vehicles' files. Since the first cycle of the day is in progress, vehicle identification information for each carrier vehicle scanned is first placed in the internal replica of the on-line order, and then its individual daily file is opened and incremented each time that particular carrier vehicle is scanned. If it is not the end of the operational day for the lift, as determined at step 64 of the flow chart of FIG. 2A, processing continues at step 56 to receive further input from the scanner. At the end of the day, in accordance with step 64 of the flow chart of FIG. 2A.If the result of the inquiry at step 58 is "yes", indicati particular carrier wvehicle is completing its first operational cycle of the day, processing continues at step 60 to continue building an internal replica of the on-line carrier vehicles by adding the vehicle identification information of the current carrier scanned to the bottom of the internal replica. Processing then proceeds to step 90 to start or open the scanned carrier vehicles' files. Since the first cycle of the day is in progress, vehicle identification information for each carrier vehicle scanned is first placed in the internal replica of the on-line order, and then its individual daily file is opened and incremented each time that particular carrier vehicle is scanned. If it is not the end of the operational day for the lift, as determined at step 64 of the flow chart of FIG. 2A, processing continues at step 56 to receive further input from the scanner. At the end of the day, in accordance with step 64 of the flow chart of FIG. 2A, this imaginary linked list is analyzed, in accordance with step 66, along with the day's usage of each vehicle, and any discrepancies or obvious errors are corrected, also in accordance with step 66. This error checking technique results in more accurate tabulation of the accumulated usage of each carrier vehicle, even if a carrier vehicle is not identified every time it passes input unit 12, as typically results from a damaged identification label on the carrier vehicle. In the event of repeated misidentification of a particular carrier vehicle, the maintenance monitoring software will alert the user to check that carrier vehicle in accordance with step 66 of the flow chart of FIG. 2A. At the end of the operational day, processing is concluded in accordance with step 92 of the flow chart of FIG. 2A by updating an ongoing overdue/near due carrier vehicle file by adding the carrier vehicles that moved within or exceeded their set maintenance tolerances during the current operational day.

Selection of one of the functions from menu section 32 of computer display 30 is detected by processing in accordance with the flow chart of FIGS. 2B and 2C. At step 94, the system is simply waiting for the user to select one of the functions from menu section 32 of computer display 30. In this state, processing cycles through the inquiry steps 102, 68, 72, 76, 80, and 84 until the result of the inquiry made at one of these steps is "yes", indicating that the user has selected a corresponding one of the functions from menu section 32 of computer display 30. If the result of the inquiry made at any one of these steps is "no", processing continues at the subsequent one of the inquiry steps 102, 68, 72, 76, 80, 84. For example, if the result of the inquiry at step 102 is "yes", indicating that the user has selected the START/STOP function 34 from menu section 32 of computer display 30 to exit the software, processing continues at step 96 to simply terminate further processing. If the result of the inquiry at step 102 is "no", processing continues at step 68. If the result of the inquiry at step 68 is "no", indicating that the user has not selected the REPORTS function 36 from menu section 32, processing continues at step 72, where the inquiry is made as to whether the user has selected the GRAPHICS function from menu section 32. If the result of that inquiry is "no", indicating that the user has not selected the GRAPHICS function 38 from menu section 32, processing continues at step 76, where the inquiry is made as to whether the user has selected the INDIVIDUAL function 40 from menu section 32. If the result of that inquiry is "no", indicating that the user has not selected the INDIVIDUAL function 40 from menu section 32, processing continues at step 80, where the inquiry is made as to whether the user has selected the SYSTEM function 42 from menu section 32 of computer display 30. If the result of that inquiry is "no", indicating that the user has not selected the SYSTEM function 42 from menu section 32, processing continues at step 84, where the inquiry is made as to whether the user has selected the OVERDUE function 44 from menu section 32 of computer display 30. If the result of that inquiry is also "no", indicating that the user has not selected the OVERDUE function 44 from menu section 32, processing returns to step 94 and again cycles through each of the inquiry steps 102, 68, 72, 76, 80, and 84.

Selection of the STOP function 34 from menu section 32 of computer display 30 causes input unit 12 to be disabled, and the error routine checks for errors that may have occurred in reading vehicle identification information in accordance with step 66 of the flow chart of FIG. 2A. When no ambiguity is detected, the errors are corrected. The permanent files containing the cumulative usage for each carrier vehicle are updated, in accordance with step 66 of the flow chart of FIG. 2A, and the current day's usage for each carrier vehicle is displayed at display position 48 of computer display 30.

Selection of the REPORTS function 36 from menu section 32 of computer display 30 allows the user to design and print maintenance and safety reports for a particular carrier vehicle, in accordance with steps 68 and 70 of the flow chart of FIG 2B. This function permits selection of a display list of all carrier vehicles that are at or beyond the cumulative usage at which maintenance is required or of a display list of all carrier vehicles within a specified tolerance of required maintenance. For example, if a tolerance of 4% is specified, a list of all carrier vehicles within four percent of required maintenance will be displayed, along with a list of all carrier vehicles that are at or beyond the cumulative usage at which maintenance is required. The vehicle identification information, maintenance status (i.e. over by 1.3% or within 3%) of the vehicle, and the type of maintenance required are all displayed. Carrier vehicles whose cumulative usage is at or beyond the cumulative usage at which maintenance is required are accordingly flagged in the display. At this point, the user must specify the one or more vehicles that are to be serviced, following which the appropriate maintenance form is printed for each vehicle specified, in accordance with step 70 of the flow chart of FIG. 2B. Since the various components of a carrier vehicle have separate maintenance schedules, the maintenance monitoring software displays the type of maintenance required at a particular level of accumulated usage.

Selection of the GRAPHICS function 38 from menu section 32 of computer display 30 allows the user to display bar graphs representative of the accumulated usage of selected maintenance level components since the last maintenance for all carrier vehicles, the accumulated usage, including intervening maintenance, for all carrier vehicles, or the accumulated usage since last maintenance for a particular carrier vehicle, in accordance with steps 72 and 74 of the flow chart of FIG. 2B. The bar graphs may be displayed in either ascending order of vehicle identification or in descending order of accumulated usage. The current bar graphs are useful in illustrating whether certain carrier vehicles are receiving more or less usage since their last maintenance, and the overall bar graphs are useful in illustrating whether certain carrier vehicles are receiving more or less long term usage. Both of these types of bar graphs are presented in order to distribute the maintenance workload as evenly as possible among the carrier vehicles, thereby preventing any long range wear effects and safety problems. The individual carrier vehicle bar graphs are useful in showing how close a particular carrier vehicle is to the various types of scheduled maintenance (i.e. -96% from grip maintenance, 4% over door maintenance, etc. ).

Selection of the INDIVIDUAL function 40 from menu section 32 of computer display 30 provides a display of several current parameters associated with a specified carrier vehicle, in accordance with steps 76 and 78 of the flow chart of FIG. 2B. These parameters include current maintenance status, the projected time and type of next maintenance, time periods (dates) of extensive inactivity, the accumulated usage since maintenance monitoring began, and the present location of the carrier vehicle. Selection of the INDIVIDUAL function 40 also enables the user to reset the usage parameter for a particular carrier vehicle following completion of scheduled maintenance on that vehicle, in accordance with step 78 of the flow chart of FIG. 2B.

Selection of the SYSTEM function 42 from menu section 32 of computer display 30 provides a display of the same parameters displayed when the INDIVIDUAL function 40 is selected, except that these parameters are displayed for all carrier vehicles, in accordance with steps 80 and 82 of the flow chart of FIG. 2B.

Selection of the OVERDUE function 44 from menu section 32 of computer display 30, along with specification of a tolerance, provides a display of all carrier vehicles requiring maintenance within the specified tolerance in accordance with steps 84 and 86 of the flow chart of FIG. 2C. Carrier vehicles that are due or overdue for scheduled maintenance are flagged in the display.

Following execution of each of the steps 70, 74, 78, 82, and 86 of FIGS. 2B and 2C, processing returns to step 94 of FIG. 2B, awaiting selection by the user of one of the user functions from menu section 32 of computer display 30.

An important aspect of the maintenance monitoring system of the present invention is that it may be accessed, by providing a valid access code, through a modem. This feature allows the maintenance manager responsible for overseeing maintenace of all of the carrier vehicles associated with a particular transportation system, or a governmental authority, to check the current maintenance status of all carrier vehicles from a remote location.

I claim:

1. A maintenance monitoring system for detachable carrier vehicles of a moving transportation system in which selected ones of the detachable carrier vehicles are periodically attached to and detached from the moving transportation system, the maintenance monitoring system comprising:

vehicle identification means attached to each detachable carrier vehicle for providing vehicle identification information;

stationary input means positioned at a specific point along a route of the moving transportation system for receiving the vehicle identification information from each one of the detachable carrier vehicles presently attached to the moving transportation system as it passes the stationary input means; and processing means, coupled to the input means, for processing the vehicle identification information at the time it is received by the input means to accumulate the usage of each detachable carrier vehicle presently attached to the moving transportation system, for comparing the accumulated usage of each detachable carrier vehicle to predetermined usage levels at which that detachable carrier vehicle is to receive scheduled maintenance, and for providing an indication to an operator whenever a particular detachable carrier vehicle has reached an accumulated usage that falls within a specified tolerance of one of said predetermined usage levels at which that detachable carrier vehicle is to be detached from said moving transportation system to receive scheduled maintenance.

2. A maintenance monitoring system for detachable carrier vehicles as in claim 1 wherein the transportation system comprises a ski chair lift and each of the carrier vehicles comprises a ski chair.

3. A maintenance monitoring system for detachable carrier vehicles as in claim 1 wherein the transportation system comprises a gondola system and each of the carrier vehicles comprises a gondola car.

4. A maintenance monitoring system for detachable carrier vehicles as in claim 1 wherein the transportation system comprises an aerial tramway system and each of the carrier vehicles comprises a tramway car.

5. A maintenance monitoring system for detachable carrier vehicles as in claim 1 wherein the vehicle identification means comprises a bar code label attached to each of the carrier vehicles and the input means comprises a laser bar code reader.

6. A maintenance monitoring system for detachable carrier vehicles as in claim 1 wherein the vehicle identification means comprises a transmitter for transmitting vehicle identification information and the input means comprises a receiver for receiving the vehicle identification information.

7. A maintenance monitoring system for detachable carrier vehicles as in claim 1 wherein the processing means includes visual display means for providing a visual indication whenever a particular carrier vehicle has reached an accumulated usage that falls within a specified tolerance of one of said predetermined usage levels at which that carrier vehicle is to receive scheduled maintenance.

8. A maintenance monitoring system for detachable carrier vehicles as in claim 1 wherein the processing means is further operative for displaying a list of all carrier vehicles that have accumulated at least enough usage to require scheduled maintenance and for displaying a list of all carrier vehicles whose accumulated usage is within a specified tolerance of requiring scheduled maintenance.

9. A maintenance monitoring system for detachable carrier vehicles as in claim 1 further comprising:

decoder means coupled to the input means for converting the vehicle identification information to formatted vehicle identification information; and a data link coupling the decoder means to the processing means.

10. A maintenance monitoring system for detachable carrier vehicles as in claim 9 wherein the decoder means converts the vehicle identification information read by the input means to ASCII format.

11. A maintenance monitoring system for detachable carrier vehicles as in claim 9 wherein the data link comprises a microwave data link.

12. A maintenance monitoring system for detachable carrier vehicles as in claim 9 wherein the data link comprises an optical data link.

13. A maintenance monitoring system for detachable carrier vehicles as in claim 9 wherein the data link comprises a radio frequency data link.

14. A maintenance monitoring system for detachable carrier vehicles as in claim 9 wherein the data link comprises a satellite data link.

15. A maintenance monitoring system for detachable carrier vehicles as in claim 9 wherein the data link comprises a computer cable.

16. A process for providing maintenance monitoring of detachable carrier vehicles of a moving transportation system in which selected ones of the detachable carrier vehicles are periodically attached to and detached from the moving transportation system, the process comprising:

providing vehicle identification information on each of the detachable carrier vehicles;

receiving the vehicle identification information from each one of the detachable carrier vehicles presently attached to the moving transportation system as it passes a specified point along a route of the moving transportation system;

processing the received vehicle identification information at the time it is received to accumulate the usage of each detachable carrier vehicle presently attached to the moving transportation system, to compare the accumulated usage of each detachable carrier vehicle to predetermined usage levels at which that detachable carrier vehicle is to receive scheduled maintenance, and to provide an indication to an operator whenever a particular detachable carrier vehicle has reached an accumulated usage that falls within a specified tolerance of one of said predetermined usage levels at which that detachable carrier vehicle is to receive scheduled maintenance; and detaching a particular detachable carrier vehicle from the moving transportation system upon said indication that it has reached an accumulated usage that falls within the specified tolerance of one of said predetermined usage levels at which that detachable carrier vehicle is to receive scheduled maintenance.

17. A process for providing maintenance monitoring of detachable carrier vehicles of a moving transportation system as in claim 16 wherein said step of processing comprises providing a visual indication whenever a particular carrier vehicle has reached an accumulated usage that falls within a specified tolerance of one said predetermined usage levels at which that carrier vehicle is to receive scheduled maintenance.

18. A process for providing maintenance monitoring of detachable carrier vehicles of a moving transportation system as in claim 16, further comprising displaying to the user a list of all carrier vehicles that have accumulated at least enough usage to require scheduled maintenance.

19. A process for providing maintenance monitoring of detachable carrier vehicles of a moving transportation system as in claim 16, further comprising displaying to the user a list of all carrier vehicles whose accumulated usage is within a specified tolerance of requiring scheduled maintenance.

* * * * *